United States Patent [19]

Willens

[11] 4,342,608

[45] Aug. 3, 1982

[54] MN-AL PERMANENT MAGNETS AND THEIR MANUFACTURE

[75] Inventor: Ronald H. Willens, Warren, N.J.

[73] Assignee: Bell Telephone Laboratories, Incorporated, Murray Hill, N.J.

[21] Appl. No.: 142,012

[22] Filed: Apr. 21, 1980

[51] Int. Cl.[3] ..... H01F 1/02

[52] U.S. Cl. ..... 148/101; 75/0.5 B; 148/31.57; 148/121

[58] Field of Search ..... 164/87, 423, 429; 148/100, 101, 102, 103, 31.57, 121, 125; 75/0.5 B, 0.5 C

[56] References Cited

U.S. PATENT DOCUMENTS

| | | | |
|---|---|---|---|
| 3,116,181 | 12/1963 | Hokkeling et al. | 148/101 |
| 3,661,567 | 5/1972 | Yamamoto | 75/134 M |
| 3,730,784 | 5/1973 | Yamamoto | 148/101 |
| 3,944,445 | 3/1976 | Ohtani et al. | 148/121 |
| 4,060,430 | 11/1977 | Kavesh | 75/0.5 B |
| 4,133,703 | 1/1979 | Kojima et al. | 148/31.57 |
| 4,155,397 | 5/1979 | Honsinger et al. | 164/87 |
| 4,221,257 | 9/1980 | Narasimhan | 164/87 |

OTHER PUBLICATIONS

Graham et al., "Magnetic Properties of Amorphous Materials" paper given at Rapidly Quenched Metals III conference, Jul. 3–7, 1978.

Kono, "On the Ferromagnetic Phase in Manganese–Aluminum System," *Journal of the Physical Soc. of Japan,* vol. 13, No. 12, Dec. 1958, pp. 1444–1451.

Koch et al., "New Material for Permanent Magnets on a Base of Mn and Al," *Journal of Applied Phys.,* Supp. to vol. 31, No. 5, May 1960, pp. 75S–77S.

Shur et al., "Influence of Plastic Deformation on the Magnetic Properties of a High Coercivity Alloy Mn–Al," *Fiz. Metal Metalloved,* vol. 23, No. 2, pp. 338–339 (1967).

McCurrie et al., "Dependence of the Permanent Magnet Properties of $Mn_{55}Al_{45}$ on Particle Size", *IEEE Tran. on Mag.,* vol. MAG14, No. 5, Sep. 1978, pp. 682–684.

Ohtami et al., "Magnetic Properties of Mn–Al–c Permanent Magnet Alloys", IEEE Transaction on Magnetics, vol. MAG–13, No. 5, Sep. 1977, pp. 1328–1330.

Duwey et al., "Rapid Quenching of Liquid Alloys" Trans. of the Metallurgical Soc. of AIME, vol. 227, Apr. 1963, pp. 362–365.

Willeno et al., "Rapid Quenching of Reactive and Refractory Alloys from the Liquid State," Tran. of the Metallurgical Soc. of AIME, vol. 236, Feb. 1966, pp. 171–174.

Maringer et al., "Casting of Metallic Filament and Fiber" Journal of Vacuum Science and Technology, vol. 11, No. 6, Nov.–Dec. 1974, pp. 1067–1071.

Pond et al., "A Method of Producing Rapidly Solidified Filamentary Castings," *Tran. of the Metallurgical Soc. of AIME,* vol. 245, Nov. 1969, pp. 2475–2476.

Duwey, "Structure and Properties of Alloys Rapidly Quench from the Liquid State" *Tran. of ASM,* vol. 60, 1967.

*Primary Examiner*—John P. Sheehan

*Attorney, Agent, or Firm*—Peter A. Businger

[57] ABSTRACT

Permanent magnet materials such as Al-Ni-Co-Fe, Mo-Co-Fe, and Co-Cr-Fe alloys comprise cobalt which has become increasingly expensive. Mn-Al is a cobalt-free magnet alloy which, according to the invention, is used to produce isotropic magnets having a maximum energy product of at least 1 million gauss-oersted. Magnets are produced by rapid quenching from a melt, e.g., by splat cooling, melt extraction, or helium blast cooling, followed by a magnetic aging heat treatment. Magnetic particles such as, e.g., fiber sections are bonded, bundled, or encased to form a magnet having desired shape.

8 Claims, 2 Drawing Figures

MN-AL PERMANENT MAGNETS AND THEIR MANUFACTURE

TECHNICAL FIELD

The invention is concerned with magnetic materials.

BACKGROUND OF THE INVENTION

Permanent magnets as used, e.g., in relays, ringers, and electroacoustic transducers are made from materials which exhibit high values of magnetic coercivity, remanence, and energy product. Among alloys possessing such desirable properties are Al-Ni-Co-Fe, Mo-Co-Fe, and Co-Cr-Fe alloys, all of which comprise cobalt as an essential constituent. In view of the relatively high cost of cobalt, alloys are desirable in which cobalt plays no essential role; in this respect Mn-Al alloys are exemplary.

Mn-Al alloys have been extensively investigated and are the subject of a number of publications. For example, a metallographic study was made by H. Kono, "On the Ferromagnetic Phase in Manganese-Aluminum System", *Journal of the Physical Society of Japan,* Vol. 13, No. 12, December 1958, pp. 1444–1451. Acceptable magnetic properties have been achieved in Mn-Al alloys in at least two ways, namely, by inducing magnetic anisotropy or by the addition of carbon. Anisotropic Mn-Al magnetic alloys are disclosed by A. J. J. Koch et al., "New Material for Permanent Magnets on a Base of Mn and Al", *Journal of Applied Physics,* Supplement to Vol. 31, No. 5, May 1960, pp. 75S–77S; by Ya. S. Shur et al., "Influence of Plastic Deformation on the Magnetic Properties of a High-Coercivity Alloy Mn-Al", *Fiz. Metal. Metalloved,* Vol. 23, No. 2, pp. 338–339 (1967); and by R. A. McCurrie et al., "Dependence of the Permanent Magnet Properties of $Mn_{55}Al_{45}$ on Particle Size", *IEEE Transactions on Magnetics,* Vol. MAG-14, No. 5, September 1978, pp. 682–684. Mn-Al alloys comprising carbon are disclosed in U.S. Pat. No. 3,661,567, issued May 9, 1972 to H. Yamamoto; and alloys which not only comprise carbon but which are also magnetically anisotropic are disclosed by T. Ohtani et al., "Magnetic Properties of Mn-Al-C Permanent Magnet Alloys", *IEEE Transactions on Magnetics,* Vol. MAG-13, No. 5, September 1977, pp. 1328–1330.

Relevant with respect to the invention are techniques of rapid quenching of alloys as disclosed, e.g., by P. Duwez et al., "Rapid Quenching of Liquid Alloys", *Transactions of the Metallurgical Society of AIME,* Vol. 227, April 1963, pp. 362–365; by R. H. Willens et al., "Rapid Quenching of Reactive and Refractory Alloys from the Liquid State", *Transactions of the Metallurgical Society of AIME,* Vol. 236, February 1966, pp. 171–174; and by R. E. Maringer et al., "Casting of Metallic Filament and Fiber", *Journal of Vacuum Science and Technology,* Vol. 11, No. 6, November–December 1974, pp. 1067–1071.

SUMMARY OF THE INVENTION

A magnetically isotropic body is produced comprising at least 97 weight percent Mn and Al and comprising little or no carbon. Relative to the combined amount of Mn and Al, Mn is preferably in a range of 70 to 76 weight percent; a resulting magnet has a magnetic energy product of at least 1 million gauss-oersted. In the interest of physical integrity of a magnetic body, carbon is preferably less than 0.5 weight percent.

Production of such magnetic body is conveniently by a method comprising quenching from a melt to a temperature at which there is no appreciable precipitation of an equilibrium phase and preferably at a rate of at least 1000 degrees C. per second. Quenching is followed by a magnetic aging heat treatment which may be at essentially constant temperature in a range of 350 degrees C. to 700 degrees C. Rapid cooling may be effected, e.g., by methods known as splat cooling, melt extraction, or helium blast cooling; resulting solid particles or fibers may be encased, bundled, or extruded into desired magnet shape.

DETAILED DESCRIPTION

Figure 1:
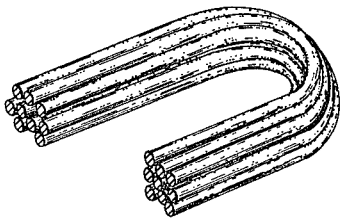
FIG. 1 schematically shows a magnet consisting of a bundle of Mn-Al fibers according to the invention.

Magnetic bodies of the invention are conveniently produced by preparing a melt comprising constituent elements Mn and Al in a combined amount of at least 97 weight percent and, in the interest of ultimate physical integrity of a magnetic body, comprising less than 0.5 weight percent carbon. Alloy constituents may be obtained from commercial grade raw materials which typically are at least 99.5 percent pure for Al and at least 47 percent pure for Mn. Among typical impurities in manganese stock are Ca, Cr, Co, Fe, Mg, Ni, Ag, P, and C; aluminum stock typically comprises amounts of Cu, Fe, Mg, Na, Si, Ti, V, Zn, and Zr. Relative to the combined amount of Mn and Al, Mn is preferably in the range of 70 to 76 weight percent or, equivalently, 53 to 60 atomic percent. Levels of Mn lower than approximately 70 weight percent are preferably avoided in the interest of preventing formation of significant amounts of nonmagnetic rhombohedral phase. And, at Mn levels beyond 76 weight percent, total magnetic moment is diminished significantly. For optimized magnetic properties a more narrow range of 71 to 74 weight percent Mn is preferred.

Melting is preferably in an inert atmosphere. The molten alloy is solidified, typically into particles, platelets, thin strips, fiber segments, or lengths of fiber by conduction cooling methods such as e.g., splat cooling or melt extraction as disclosed in cited references by Duwez et al., Willens et al., and Maringer et al. Alternatively, cooling may be by helium blast cooling.

Cooling is to a temperature which is sufficiently low to prevent appreciable precipitation of an equilibrium phase preferably throughout at least 90 percent of the volume of a body. Such temperature is preferably less than or equal to 700 degrees C. and may more conveniently be room temperature. Preferred cooling rates are at least 1000 degrees per second; conduction cooling typically results in cooling rates which are greater than $10^5$ degrees per second and which typically are on the order of $10^6$ degrees C. per second. Splat cooling may result in cooling rates on the order of $10^9$ degrees C. per second.

Resulting fibers, fiber fragments, or particles are given a magnetic aging heat treatment which is simplest form may consist in heating at an approximately constant temperature in the preferred range of 300 to 700 degrees C. Alternatively, aging temperature may very according to a desired schedule. Optimal aging times and temperatures are indirectly related and, moreover, depend on quench rate. Specifically, for a quench rate of approximately $10^5$ degrees per second, typical combinations of aging time and temperature are 72 hours at 350 degrees C., 35 minutes at 450 degrees C., 5 minutes at 500 degrees C., and less than 1 minute at 700 degrees C. If quench rate is increased, shorter times or lower temperatures are indicated; if quench rate is lowered, optimal time is lengthened or temperature raised. Due to the small diameter or thickness of rapidly quenched particles or fibers, short-term aging at elevated temperature is feasible without undue inhomogeneity of temperature in a particle or fiber.

Aged particles, fiber fragments, or lengths of fiber may be combined into a desired magnet by extruding bonding, bundling, or encasing in a suitable substance such as, e.g., a resin or wax. Adhesively bonded fibers forming a horseshoe magnet are shown in FIG. 1; differently shaped magnets may be similarly obtained. If a sufficiently heat resistant material is used for bonding, bundling or encasing, the aging heat treatment described above may be applied after rather than prior to forming into desired shapes.

Figure 2:
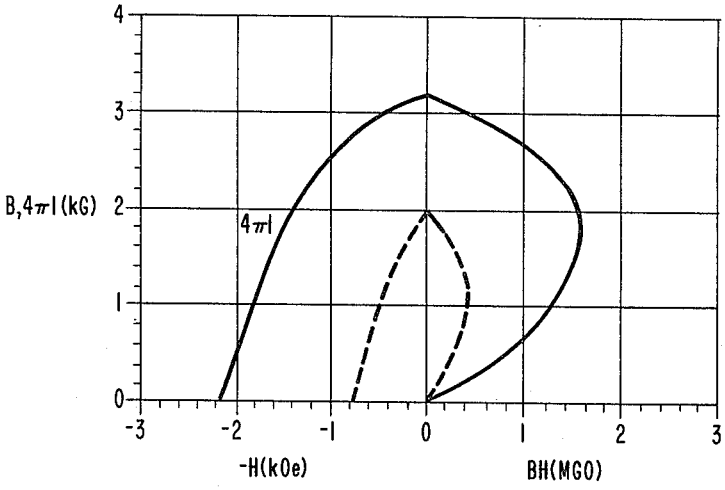
FIG. 2 is a diagram of demagnetizing field (−H) versus magnetization ($4\pi I$) and magnetic energy product BH versus magnetic induction B for a prior art magnet and a magnet of the invention.

FIG. 2 shows demagnetization and energy product curves for an $Mn_{55}Al_{45}$ magnet alloy made according to the invention (solid lines) as compared with a prior art magnet alloy having the same composition (broken lines). The latter are as shown in the Shur reference cited above.

It can be seen from FIG. 2 that maximum energy product is approximately 1.6 million gauss-oersted for the magnet of the invention as compared with a corresponding value of 0.4 million gauss-oersted for the prior art magnet.

EXAMPLE 1

A melt of $Mn_{55}Al_{45}$ alloy was prepared by melting 71.3 parts by weight Mn and 28.7 parts by weight Al in a boron nitride crucible in a helium atmosphere. A 3.6 cm long, 0.64 cm diameter rod was obtained by chill casting the melt in a copper mold. A sample consisting of a 1.8 cm section of the rod was melted by RF induction heating in a boron nitride crucible in a helium-filled enclosure of melt extraction apparatus. A 20.3 cm diameter copper disk having V-shaped edge was rotated in a vertical plane at 3000 revolutions per minute and lowered onto the melt surface. This resulted in the extraction of fibers from the melt with fiber diameter ranging from 10 to 25 micrometer and length ranging from 3 to 20 millimeter. Depletion of melt was compensated for by gradually lowering the spinning wheel.

The fibers were heat treated at a temperature of 450 degrees C. for 25 minutes and a composite was made by casting approximately 500 fibers in wax. Fibers were aligned parallel by a magnetic field. Measurement of magnetic properties yielded values of remanence $B_r=3180$ gauss, coercivity $H_c=2140$ oersted, and maximum magnetic energy product $(BH)_{max}=1.6$ million gauss-oersted.

EXAMPLE 2

Fibers were produced as described in Example 1 above, but heat treatment was at a temperature of 355 degrees C. for 70 hours. Measurement of magnetic properties yielded values of remanence $B_r=2780$ gauss, coercivity $H_c=1800$ oersted, and maximum energy product $(BH)_{max}=1.1$ million gauss-oersted.

EXAMPLE 3

Fibers were produced as described in Example 1 above, but heat treatment was at a temperature of 500 degrees C. for 35 minutes. Measurement of magnetic properties yielded values of remanence $B_r=3180$ gauss, coercivity $H_c=1750$ oersted, and maximum energy product $(BH)_{max}=1.4$ million gauss-oersted.

I claim:

1. Method for producing a permanent magnet element which is magnetically essentially isotropic, said method comprising thermal treatment of at least one metallic body which comprises Mn and Al in a combined amount of at least 97 weight percent of said body, said body comprising Mn in the range of 70 to 76 weight percent of said amount, said body comprising less than 0.5 weight percent carbon, said thermal treatment comprising heating at an essentially constant temperature in the range of 300 to 700 degrees Celsius, said method being characterized in that preparation of said body comprises cooling from a melt, cooling being such that throughout at least 90 percent of the volume of said body, temperature is reduced at a rate which is greater than or equal to 1000 degrees per second to a temperature at which there is no appreciable precipitation of an equilibrium phase, whereby upon completion of said thermal treatment said magnetic element has a magnetic energy product which is greater than or equal to 1 million gauss-oersted.

2. Method of claim 1 in which cooling from a melt is to a temperature which is less than or equal to 700 degrees C.

3. Method of claim 2 in which cooling from a melt is to room temperature.

4. Method of claim 1 in which cooling is at a rate which is greater than or equal to $10^5$ degrees C. per second.

5. Method of claim 4 in which cooling is at a rate which is greater than or equal to $10^6$ degrees C. per second.

6. Method of claim 1 in which said metallic body comprises Mn in the range of 71 to 74 weight percent of said amount.

7. Method of claim 1 in which said metallic body in a particle, platelet, strip, or fiber.

8. Method of claim 1 in which a plurality of said at least one metallic body is combined into a desired shape.

* * * * *

UNITED STATES PATENT AND TRADEMARK OFFICE

CERTIFICATE OF CORRECTION

PATENT NO. : 4,342,608

DATED : August 3, 1982

INVENTOR(S) : Ronald H. Willens

It is certified that error appears in the above—identified patent and that said Letters Patent is hereby corrected as shown below:

Column 2, line 65, "is" should read --in--; line 68, "very" should read --vary--. Column 4, line 56, "in" should read --is--.

Signed and Sealed this

Fourteenth Day of December 1982

[SEAL]

*Attest:*

GERALD J. MOSSINGHOFF

*Attesting Officer*

*Commissioner of Patents and Trademarks*